US007629933B2

(12) United States Patent
Wen et al.

(10) Patent No.: US 7,629,933 B2
(45) Date of Patent: Dec. 8, 2009

(54) MULTI-BAND ANTENNA, AND ASSOCIATED METHODOLOGY, FOR A RADIO COMMUNICATION DEVICE

(75) Inventors: Geyi Wen, Waterloo (CA); Shirook Ali, Mississauga (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 363 days.

(21) Appl. No.: 11/843,825

(22) Filed: Aug. 23, 2007

(65) Prior Publication Data

US 2009/0051596 A1 Feb. 26, 2009

(51) Int. Cl.
*H01Q 1/24* (2006.01)

(52) U.S. Cl. ..... 343/702; 343/700 MS; 343/795; 343/850

(58) Field of Classification Search ..... 343/700 MS, 343/702, 750, 793, 795, 850, 852
See application file for complete search history.

(56) References Cited

U.S. PATENT DOCUMENTS 6,407,710 B2 * 6/2002 Keilen et al. ..... 343/702
6,683,571 B2 1/2004 Ghosh et al.
6,958,731 B2 * 10/2005 Achim ..... 343/702
6,987,494 B2 * 1/2006 Keren ..... 343/895
7,084,825 B2 * 8/2006 Sakae et al. ..... 343/788
7,196,664 B2 * 3/2007 Asai ..... 343/700 MS
2002/0101382 A1 8/2002 Konishi
2003/0001781 A1 1/2003 Konishi

* cited by examiner

*Primary Examiner*—Douglas W Owens
*Assistant Examiner*—Chuc D Tran

(57) ABSTRACT

An antenna, and an associated methodology, for a portable radio device, such as a mobile station capable of operation at a plurality of frequency bands spread across a wide range of frequencies. The antenna includes a dielectric substrate and a monopole disposed about the substrate. The monopole includes a first end having a feed point connection and is folded in a serpentine manner about at least three planar surfaces of the substrate. A first patch element improves matching at a first frequency band, extends from the monopole. A second patch element improves matching at a second frequency band, extends from the monopole and is proximate to the feed point connection. A third patch element improves matching at a third frequency band, extends from a second end of the monopole, opposed to the feed point connection.

20 Claims, 8 Drawing Sheets f = 908 MHz f = 1.84 GHz

MULTI-BAND ANTENNA, AND ASSOCIATED METHODOLOGY, FOR A RADIO COMMUNICATION DEVICE

The present invention is generally directed to a manner by which to transduce signal energy at a radio device, such as a portable mobile station. More particularly, the present invention relates to an antenna, and an associated methodology, for the radio device.

The antenna is of dimensions permitting its positioning within, or carriage together with, a hand-carriable mobile station while providing operability over a wide range of frequencies. The antenna is formed of a wire antenna (monopole) and a set of patches that are configured together in a tri-dimensional arrangement. The spatial requirements of the antenna are reduced by folding one of the patches into folded portions. The antenna is operable with a multi-mode radio device that operates at multiple, spaced frequency bands.

BACKGROUND OF THE INVENTION

Mobile communications have become pervasive throughout modern society. Ready access to a mobile communication system is, for many, a practical necessity. A cellular, or cellular-like communication system is an exemplary mobile radio communication system whose availability is widespread throughout significant portions of the populated areas of the world.

A cellular communication system is constructed generally to be in conformity with operational requirements set forth in an operating specification promulgated by a standards-setting body. The operating specification, amongst other things, defines a radio air interface extending between communication stations, i.e., the network infrastructure and a mobile station, operable in the communication system. Regulatory bodies allocate portions of the electromagnetic spectrum. Different allocations are made for different types of systems, and different regulatory bodies regulate the use of the electromagnetic spectrum in different jurisdictions. And, operating standards associated with different communication systems define operating parameters including parameters associated with the frequencies upon which the radio air interface is defined.

While early implementations of mobile stations used to communicate in a cellular communication system were relatively bulky and heavy, advancements in integrated-circuit processing, and communication technologies have permitted the miniaturization of newer implementations of mobile stations. Mobile stations are now regularly of dimensions permitting their hand-carriage. And, increasingly, mobile stations are constructed to be operable in conformity with the operating requirements of more than one operating standard. Such a mobile station, referred to as a multi-mode mobile station, is capable of operation pursuant to a communication service by way of any communication system with which the multi-mode mobile station is operable.

Miniaturization of a mobile station provided as a result of the technological advancements noted-above has permitted the circuitry required for multi-mode mobile station to be housed in a housing of small dimension. Multi-mode mobile stations are, for example, sometimes of configurations permitting their carriage in a shirt pocket of a user. Miniaturization is provided, not only by reducing the physical dimensions of the circuit paths of the receive and transmit chains of the circuitry of the mobile station, but also through sharing of circuit components between circuit paths used for communications pursuant to the different communication systems.

Miniaturization of antenna elements present unique challenges, particularly when the antenna element is to form part of a multi-mode mobile station, operable at disparate frequency bands. An antenna element is generally most effective in transducing signal energy when the transducer is of dimensions related to the wavelength of the signal energy that is to be transduced. For instance, antenna lengths corresponding to, or multiples of, one-quarter wavelengths of the signal energy that is to be transduced exhibit good antenna characteristics. When the mobile station forms a multi-mode mobile station that operates at different frequency bands, different sizes of antennas are needed to transduce the signal energy of the different frequencies and wavelengths. As the sizes of housings otherwise required to house the circuitry of a multi-mode mobile station continue to decrease, dimensional requirements of the antenna elements are sometimes a factor limiting further miniaturization of a mobile station. Significant effort has therefore been exerted to construct an antenna, operable over multiple frequency bands, that is also of small dimension, thereby to permit its positioning within the housing of a mobile station.

A PIFA (Planar Inverted-F Antenna) is sometimes utilized to transduce signal energy at a mobile station. Generally, a PIFA is of compact size and is of a low profile while providing for transducing of signal energy at more than one frequency band. A problem typically exhibited with a PIFA, however, is that a PIFA generally exhibits pass bands of narrow bandwidths. A bandwidth of a PIFA is enhanced by configuring the PIFA together with a parasitic element. Such use of a parasitic element, however, increases the dimensions of the antenna. Also, the branches sometimes introduce EMC and EMI that interferes with antenna operation.

An improved antenna structure, of small dimensions, and operable to transduce signal energy at multiple, disparate frequency bands is therefore needed.

It is in light of this background information related to radio communications that the significant improvements of the present invention have evolved.

DETAILED DESCRIPTION

Figure 1:
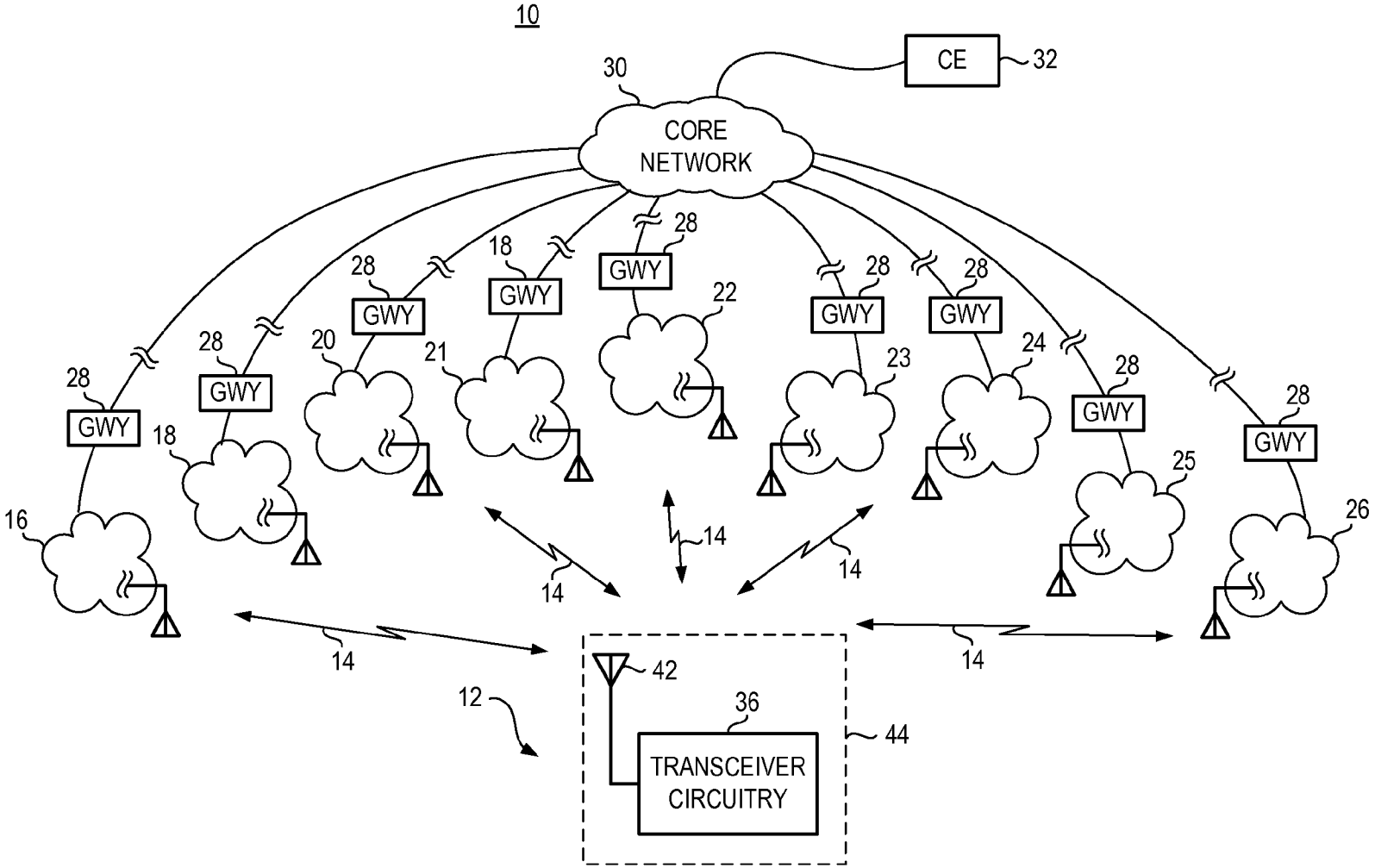
FIG. 1 illustrates a functional block diagram of a radio communication system in which an embodiment of the present invention is operable.

The present invention, accordingly, advantageously provides an antenna, and an associated methodology for transducing signal energy at a radio device, such as a portable mobile station.

Through operation of an embodiment of the present invention, an antenna is provided for the radio device. The antenna is of compact dimensions that permits its positioning within, or carriage together with, a mobile station. The characteristics of the antenna permit its operation at selected frequency bands over a wide range of frequencies.

The antenna includes a wire antenna (monopole) and a set of patches that are configured together in a tri-dimensional arrangement that extends in multiple planar directions. Reduction in the spatial requirements of the antenna is provided by the tri-dimensional configuration of the antenna. The antenna is configured to be operable at disparate frequency bands over a wide range of frequencies.

In another aspect of the present invention, a monopole, formed of multiple folded portions, extends in a serpentine manner across six planar surfaces of a dielectric substrate. The monopole includes a first end and a second end. The first end of the monopole defines a feed connection point connectable with corresponding portions of circuitry of a mobile station. Signal energy generated at the mobile station circuitry is provided to the antenna at the feed point connection, and signal energy transduced into electrical form at the antenna is provided to the transceiver circuitry at the feed point connection.

A first patch of the antenna forms a first main matching element, and is, e.g., rectangular-shaped, forming a rectangular-shaped patch, extending from, and contiguous and integral with, the monopole. The first patch improves matching to provide for antenna resonance at a first frequency band, depending upon the size of the patch and its location of connection to the monopole. A second antenna patch forms a second matching element proximate to the feed point connection and extending from, and contiguous and integral with, said monopole. The second patch improves matching to provide for antenna resonance is resonant at least at a second frequency band. A third patch forms a third matching element, extending from and contiguous and integral with, the second end of the monopole. The third patch improves matching to provide for antenna resonance is resonant at least at a third frequency band. By use of the antenna disclosed herein, the spatial requirements of the antenna are reduced relative to the space that would be required to be provided if the antenna were not folded.

In one implementation, the antenna forms at least a nine-band antenna, capable of operation at nine disparate frequency bands, including the 800, 900, 1500, 1800, 1900, 2000, 2200, 2400, and 2450 MHz frequency bands. In other implementations, the antenna is configured to be resonant at other, and other numbers of, frequency bands. When connected to transceiver circuitry capable of operating in conformity with communication systems at the corresponding frequencies, the antenna permits signal energy to be transduced at any of the resonant frequencies. Due to its compact size, the antenna facilitates increased miniaturization of a mobile station, permitting its positioning within the housing of the mobile station.

In these and other aspects, therefore, an antenna, and an associated methodology is provided for a radio communication device. A substrate is fabricated from a dielectric and a monopole is disposed thereon. A first patch, defined in a first planar direction and contiguous and integral with the monopole, forms a first matching element that improve matching to provide for antenna resonance at least at a first frequency band. A second patch, defined in a second planar direction and contiguous and integral with the monopole, forms a second matching element that improves matching to provide for antenna resonance at least at a second frequency band. A third patch, defined in the second planar direction and contiguous and integral with the monopole, forms a third matching element that improves matching to provide for antenna resonance at least at a third frequency band.

Referring first, therefore, to FIG. 1, a radio communication system, shown generally at 10, provides for voice and data (referred to collectively herein as "data") communication services, with radio devices, such as mobile stations, of which a mobile station 12 is representative, by way of radio links defined upon a radio air interface 14. While the mobile station 12 is generally representative of a mobile station operable in conformity with operating protocols of any of various operating specifications, in the exemplary implementation, the mobile station 12 is operable to communicate in eleven modes of communication, namely, at the 800, 900, 1800, and 1900 MHz frequency bands that correspond to four GSM (Global System for Mobile communications) frequency bands, the 2200 MHz frequency band that corresponds to a UMTS (Universal Mobile Telephone Service) band, a 1500 MHz frequency band that corresponds to a GPS (Global Positioning System) band, a 2000 MHz frequency band that corresponds to an IMT (International Mobile Telecommunications) band, 1800 and 1900 MHz frequency bands that correspond to DCS (Data Communications System) and PCS (Personal Communications System) bands, a 2400 MHz frequency band that corresponds to a Bluetooth band, and a 2450 MHz frequency band that corresponds to a WLAN (Wireless Local Area Network) band. Operability of the mobile station at the aforementioned modes and frequencies provides a mobile station that is permitting of operation in a majority of the world-wide areas that provide for cellular-type communications.

A plurality of radio access networks (RANs) 16, 18, 20, 21, 22, 23, 24, 25, and 26 are illustrated in FIG. 1. The RANs 16-26 are representative, respectively, of a GSM 800 MHz network, a GSM 900 MHz network, a GSM/DCS/PCS 1800 MHz network, a GSM/DCS/PCS 1900 MHz network, a GPS 1500 MHz network, an IMT 2000 MHz network, a UMTS 2200 MHz network, a Bluetooth 2400 MHz network, and a WLAN 2450 MHz network, respectively. When the mobile station 12 is positioned within the coverage area of any of such RANs 16-26, the mobile station is capable of communicating with the RANs. Here, merely for purposes of simplicity, the mobile station 12 is positioned within the coverage of each of the RANs. That is to say, in the illustrated example, all of the RANs have overlapping coverage areas. In an actual implementation, various of the RANs are implemented in separate, and non-overlapping, jurisdictional areas. The RANs 16-26 are coupled, here by way of gateways (GWYs) 28, to a core network 30. A communication endpoint (CE) 32 is coupled to the core network. The CE 32 is representative of a communication device that communicates with the mobile station.

The mobile station 12 sends data upon the radio air interface 14 and receives data communicated thereon. Transceiver circuitry 36 is embodied at the mobile station 12, formed of a transmit part and a receive part to operate upon data that is to be communicated by the mobile station or data that is received thereat. The receive and transmit chains forming the receive and transmit parts, respectively, of the transceiver circuitry are operable in conformity with the operating standards and protocols associated with, and defining, the respective systems. The transceiver circuitry 36 of the mobile station 12 is coupled to an antenna 42 of an embodiment of the present invention. The antenna 42 is constructed to permit its operation to transduce signal energy at all of the frequency bands at which the mobile station 12 transceiver circuitry 36 is operable. That is to say, in the exemplary implementation, the antenna 42 operates to transduce signal energy at any of the 800, 1500, 1800, 1900, 2000, 2200, 2400, and 2450 MHz frequency bands. In the exemplary implementation, the antenna 42 is positioned within a housing 44 of the mobile station 12 to be supportively enclosed by the housing. Howsoever positioned, the antenna 42 is of relatively small dimensions, facilitating its carriage together with the mobile station 12 at any of the frequencies at which the mobile station operates. Where desired, multiple antennas 42 may be configured in an array of two or more antennas for enhancing the communication of signals to and from the mobile station 12.

Figure 2:
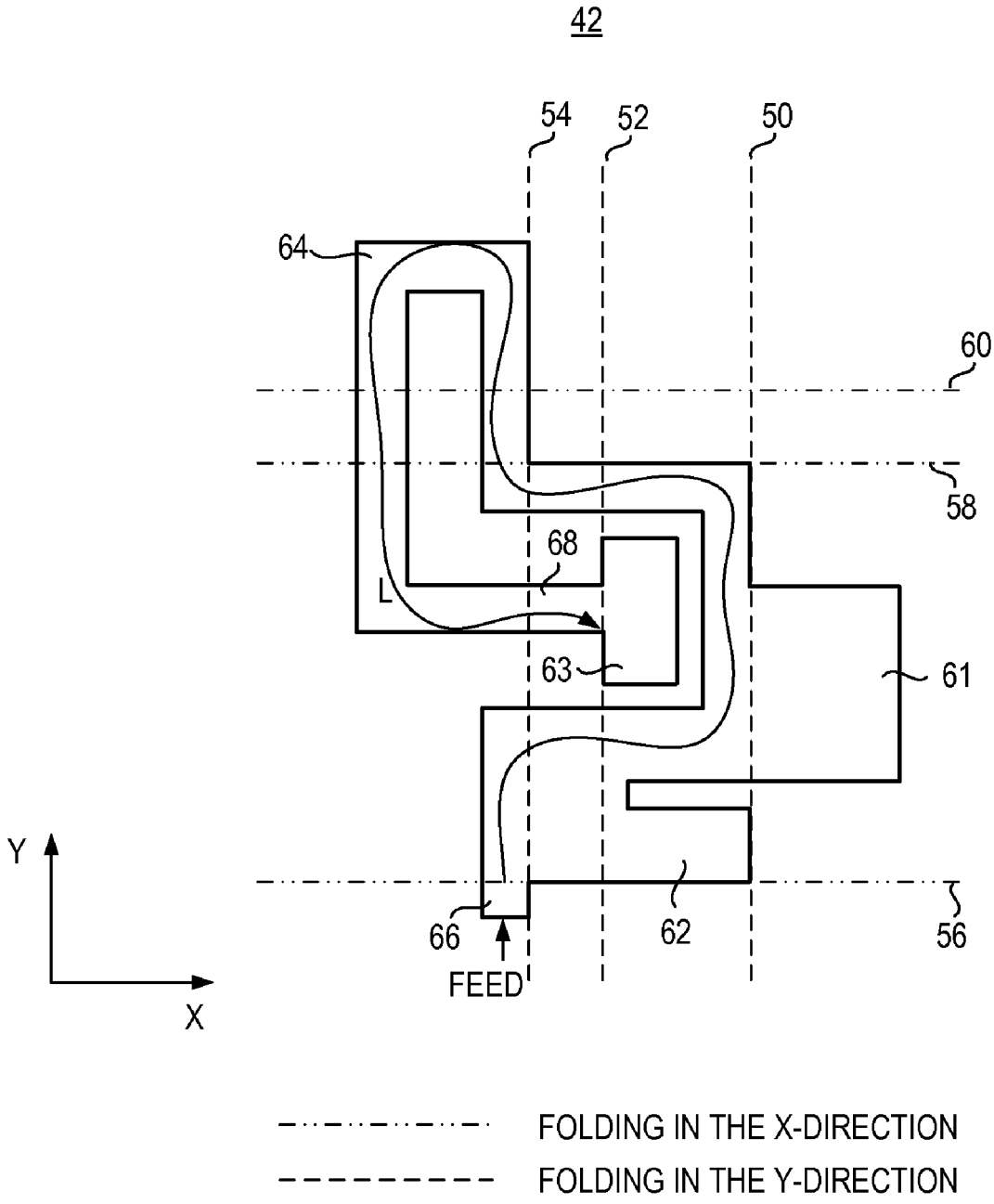
FIG. 2 illustrates a two-dimensional representation of the configuration of the antenna of an embodiment of the present invention.

FIG. 2 illustrates the antenna 42, shown in FIG. 1 to form part of the mobile station 12. The exemplary implementation shown in FIG. 2 forms a nine-band antenna that operates in conjunction with a mobile station to transduce signal energy during its operation. The view shown in FIG. 2 is a 2-D plan view representative of the pattern of the antenna prior to configuration into a tri-dimensional form. And, once formed, the antenna 42 is folded at fold lines 50, 52, 54, 56, 58, and 60 as shall be described in further detail below. By forming the folds in the antenna 42, the antenna is shaped into three dimensions to be tri-dimensional in shape. As each of the folds taken along the respective folding lines, in the exemplary implementation, forms a substantially perpendicular angle (e.g., about 85°-95°, preferably 90°), the resultant form of the antenna is substantially rectangular.

The antenna 42 includes a monopole 64 and three antenna patches, a first antenna patch 61, a second antenna patch 62, and a third antenna patch 63 which improve the matching for low and high frequency bands of the antenna 42. The monopole 64 includes a first end 66 and extends in a serpentine manner to a second end 68. The first end 66 is also effective as a feed point connection to the transceiver circuitry (shown in FIG. 1) of the mobile station 12. The monopole 64 preferably extends a length L, such as a quarter of wavelength at 800 MHz, which controls the fundamental resonating mode of the antenna. Modes at higher frequencies are generated since the length L is a multiple of one-quarter wavelengths of the higher frequencies.

The first antenna patch 61 can be rectangular-shaped and is constructed to extend from a fold at fold line 50 and to be contiguous to, and integral with, portions of the monopole 64. The second antenna patch 62 can be rectangular-shaped and is constructed to extend from a fold line 52 and to be contiguous to, and integral with, portions of the monopole 64 proximate to the feed point connection 66. The third antenna patch 63 can be rectangular-shaped and is constructed to extend from a fold line 52 and to be contiguous to, and integral with, portions of the monopole 64 proximate to the second end 68. Each of the first antenna patch 61, second antenna patch 62, and third antenna patch 63 are preferably configured to improve matching to provide for antenna resonance at one or more frequency bands determined by the characteristics desired of the respective antenna patch. Appropriate selection of the dimensions of the patches is, in significant part, determinative of the operable frequency band of the respective antenna patches. By way of example, in one exemplary, nine-band embodiment, the first antenna patch 61 is configured to exhibit a resonant band of a relatively low frequency, such as, 800 MHz and/or 900 MHz.

Figure 3:
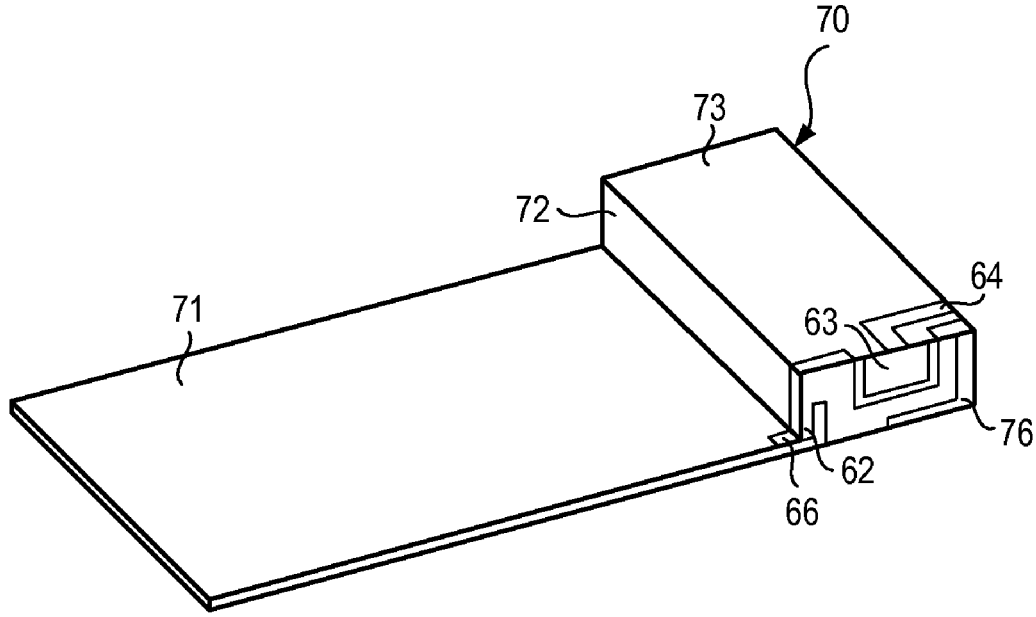
FIGS. 3-5 illustrate various perspective representations of the antenna shown in FIG. 2, here in which the antenna is configured with folds formed of a wire (monopole) loaded with patches about a dielectric substrate.
Figure 4:
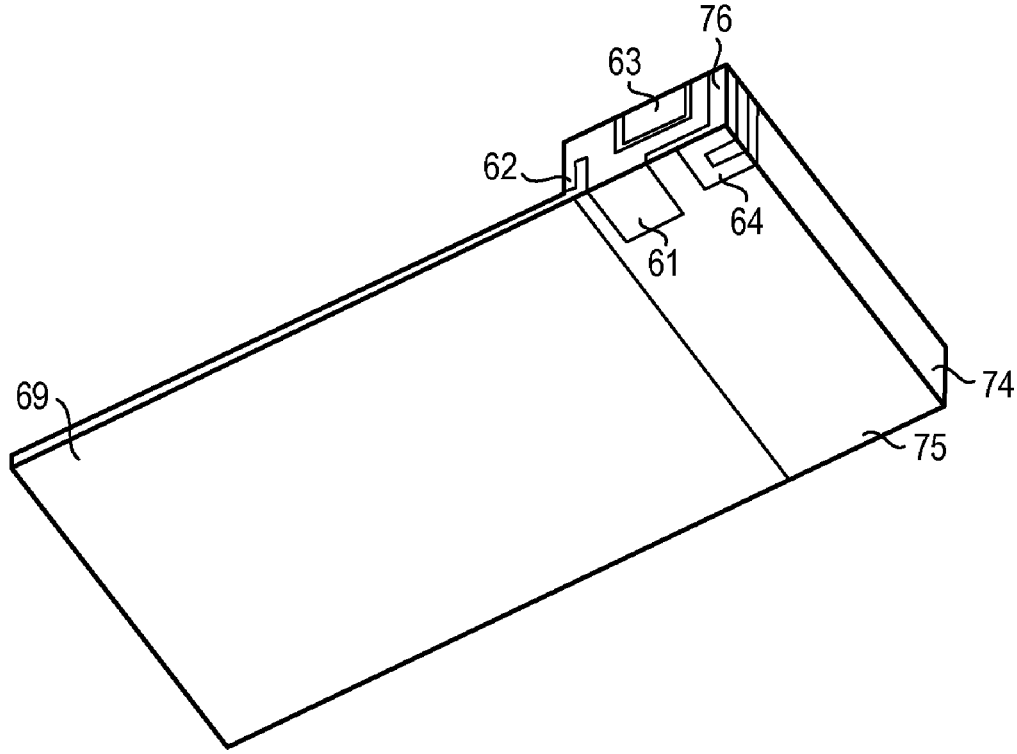
Figure 5:
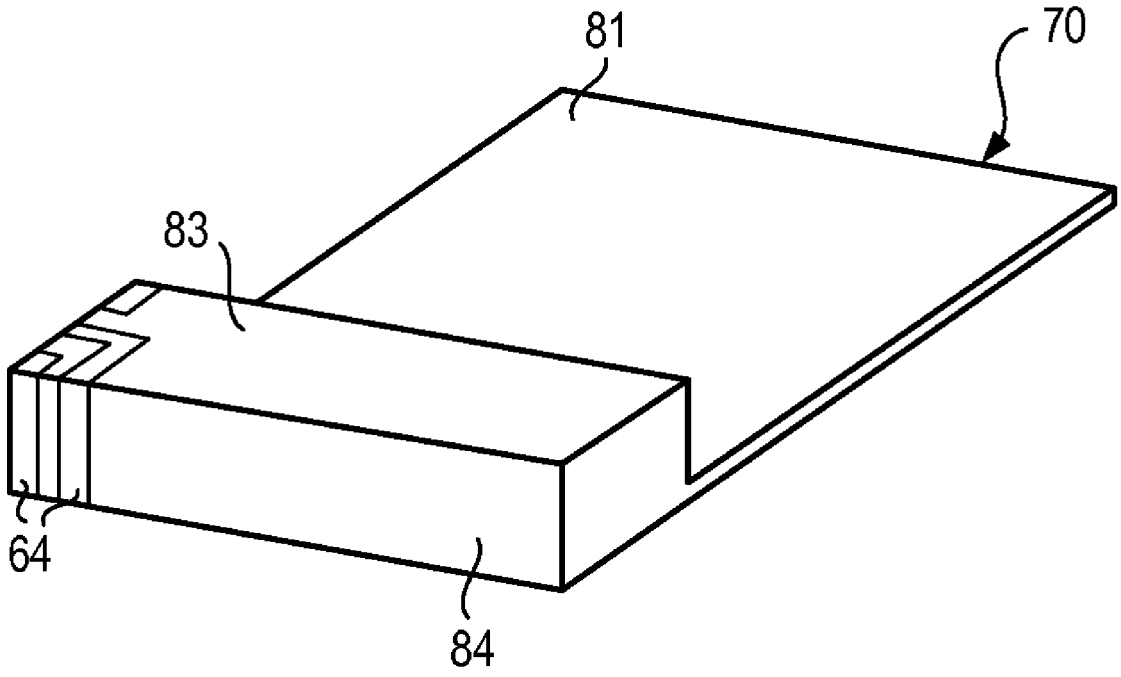

FIGS. 3-5 illustrate a perspective view of the antenna 42 of FIGS. 1 and 2 disposed on a substrate 70. The transceiver circuitry 36 (not shown in FIGS. 3-5) is mounted on the substrate 70 and coupled to the feed point connection 66. In one exemplary implementation, the substrate 70 is fabricated from an FR-4 dielectric of a thickness of about 1.5 millimeters and is of a relative permittivity of about 4.4. The substrate 70 defines a first planar surface 71. A second planar surface 72 extends from and is perpendicular to the first planar surface 71. A third planar surface 73 extends from and is perpendicular to the second planar surface 72, and is parallel to the first planar surface 71. A fourth planar surface 74 extends from and is perpendicular to the third planar surface 73, and is parallel to the second planar surface 72. A fifth planar surface 75 extends from and is perpendicular to the fourth planar surface 74, and is parallel to the first planar surface 71 and third planar surface 73. A sixth planar surface 76 is perpendicular to the first planar surface 71, second planar surface 72, third planar surface 73, fourth planar surface 74, and fifth planar surface 75.

Folded in accordance with fold lines 50, 52, 54, 56, 58, and 60 depicted in FIG. 2, the first end, or feed connection point, 66 of the monopole 64 is disposed on the first planar surface 71, and the monopole extends sequentially in a serpentine manner across the second planar surface 72, the third planar surface 73, the sixth planar surface 75, the third planar surface 73, the fourth planar surface 76, and the fifth planar surface 73. The first antenna patch 61 extends from the monopole 64 onto the fifth planar surface 75. The second antenna patch 62 extends from the monopole 64 onto the sixth planar surface 76 proximate to the first end, or feed connection point, 66 of the monopole. The third antenna patch 63 extends from the second end of the monopole 64 onto the sixth planar surface 76. A ground plane 69 is disposed on a portion of the planar surface 75 and is preferably sized at about 55 millimeters by 90 millimeters. The conductive paths of the monopole 64 and first, second, and third antenna patches 61, 62, and 63, respectively, of the antenna are of lengths and widths that are resonant at selected frequency ranges, selected in the exemplary implementation to be resonant at nine frequency ranges, including the 800, 900, 1500, 1800, 1900, 2000, 2200, 2400, and 2450 MHz bands. Due to the folded nature of the antenna, the space required on the dielectric substrate 70 is reduced relative to a two-dimensional implementation. The folded nature of the antenna 42 also controls the current distribution along the monopole length L of the monopole, thereby controlling the electric length(s) for higher resonant frequency band(s) as well as the antenna bandwidth.

Figure 6:
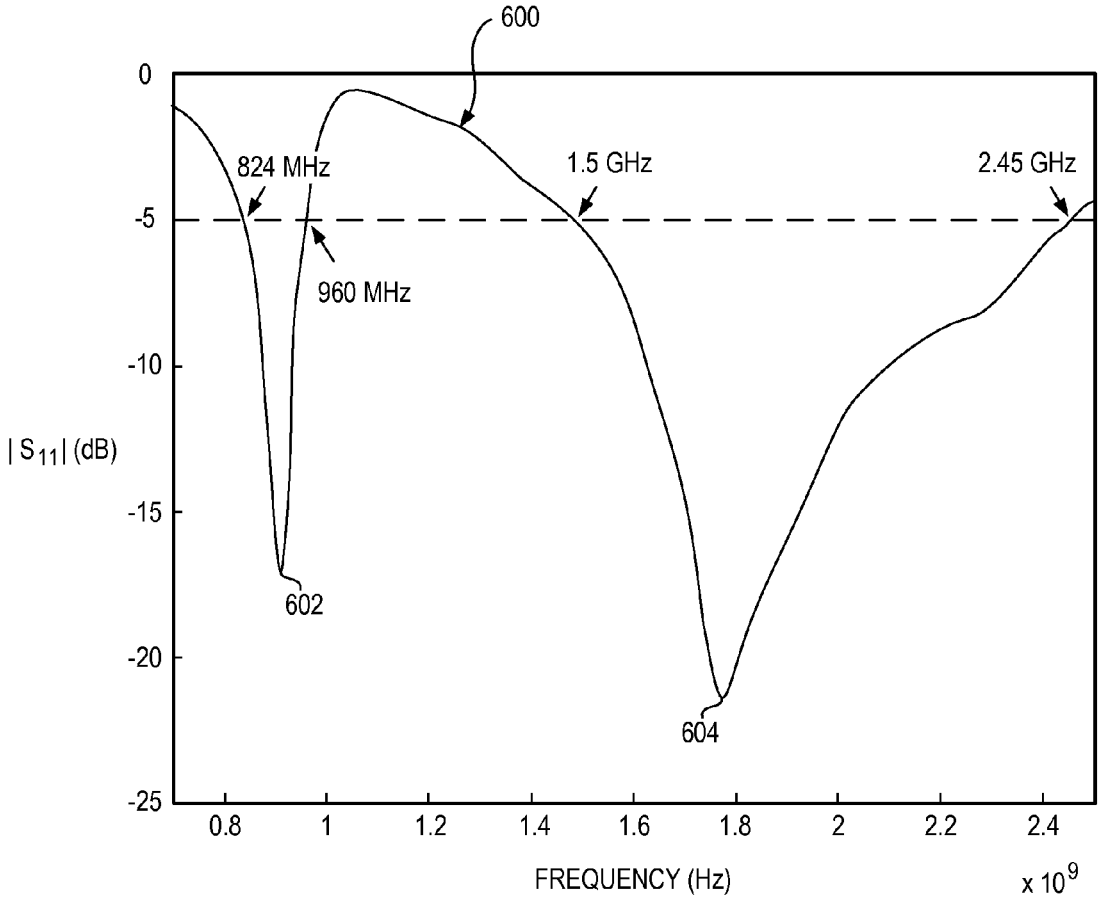
FIG. 6 illustrates a representation of an exemplary return loss, plotted as a function of frequency, of an exemplary antenna of an embodiment of the present invention.

FIG. 6 illustrates a graphical representation 600 that shows exemplary return loss of an exemplary antenna 42 shown in any of the preceding figures. Review of the representation illustrates pass bands 602 and 604. Through appropriate selection of the configuration of the antenna, the pass bands are located at other frequencies.

Figure 7:
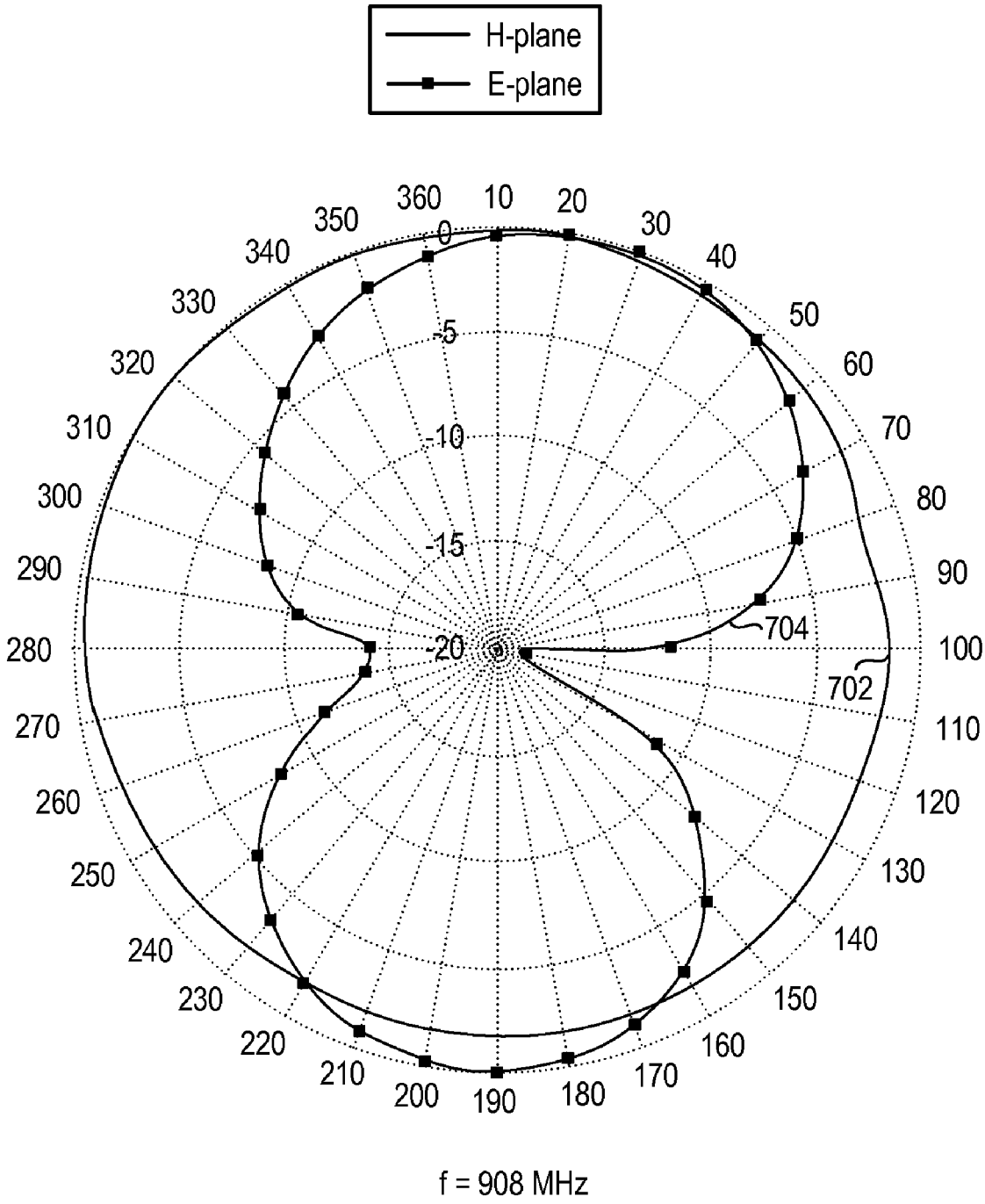
FIGS. 7 and 8 represent exemplary radiation patterns exhibited by the antenna of an embodiment of the present invention at two separate frequencies, at 908 MHz and 1.84 GHz, respectively.
Figure 8:
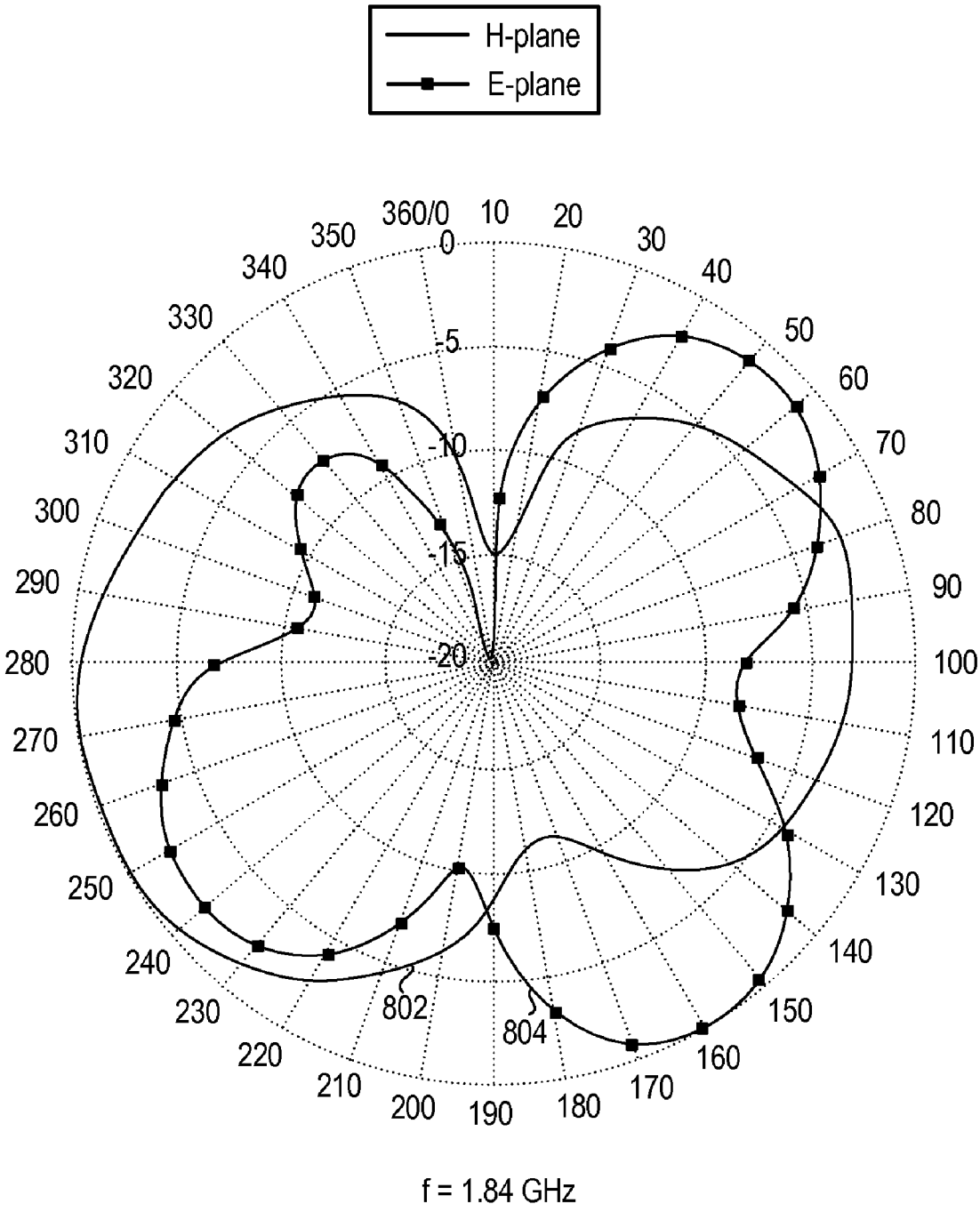

FIGS. 7 and 8 illustrate exemplary radiation patterns exhibited by the antenna 42 in an exemplary implementation. In FIG. 7, a first plot 702 is representative of the radiation pattern at 908 MHz in the H-plane. And, the curve 704 is representative of the radiation pattern at 908 MHz frequency, but in the E-plane.

Analogously, in FIG. 8, a radiation pattern 802 is representative of the radiation pattern at 1840 MHz in the H-plane. And, the radiation pattern 804 is representative of the radiation pattern, at the same frequency, but in the E-plane.

Figure 9:
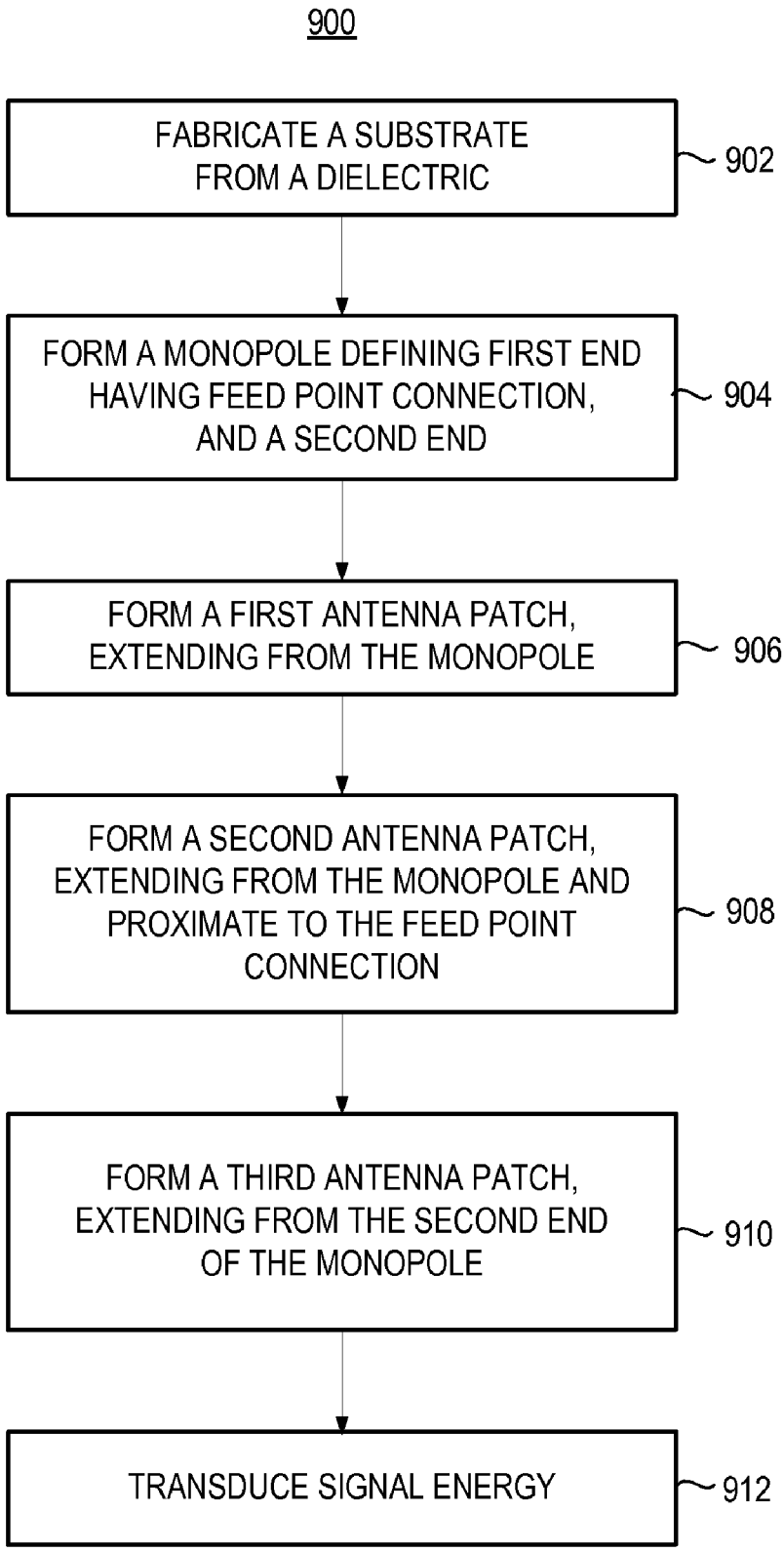
FIG. 9 illustrates a method flow diagram representative of a method of operation of an embodiment of the present invention.

FIG. 9 illustrates a method flow diagram shown generally at 900, representative of the method of operation of an embodiment of the present invention for transducing signal energy at a radio device such as a mobile station.

First, and as indicated by the block 902, the substrate 70 is fabricated from a dielectric characterized as described above. In step 904, the monopole 64 is formed on the substrate 70, with a first end and a second end, the first end being operative as a feed connection point. The monopole is folded about six fold lines 50, 52, 54, 56, 58, and 60, and disposed on the first, second, third, fourth, fifth, and sixth planar surfaces 71, 72, 73, 74, 75, and 76 of the substrate, as discussed above with respect to FIGS. 3-5. The monopole 64 may be tuned by suitably adjusting the fold lines and lengths of each portion of the monopole. That is to say, the method further includes the operation of tuning the monopole.

In step 906, with the antenna folded at the fold line 50, the first antenna patch 61 is formed on the fifth planar surface 75 of the substrate, extending from, and contiguous and integral with, the monopole, to thereby form a first matching element to improve matching to provide for antenna resonance at a first frequency band. In step 908, with the antenna folded at the fold line 52, the second antenna patch 62 is formed on the sixth planar surface 76 of the substrate, extending from, and contiguous and integral with, the monopole, proximate to the feed connection point 66, to thereby form a second matching element to improve matching to provide for antenna resonance at a second frequency band. In step 910, with the antenna folded at the fold line 52, the third antenna patch 63 is formed on the sixth planar surface 76 of the substrate, extending from, and contiguous and integral with, the second end 68 of the monopole, to thereby form a third matching element to improve matching to provide for antenna resonance at a third frequency band.

At step 912, signal energy is transduced within any of the frequency bands of the antenna 42.

Due to the tri-dimensional configuration of the antenna, a multi-band antenna is formed, of compact configuration, facilitating its use together with a mobile station, or other portable radio device.

Presently preferred embodiments of the invention and many of its improvements and advantages have been described with a degree of particularity. The description is of preferred examples of implementing the invention, and the description of preferred examples is not necessarily intended to limit the scope of the invention. The scope of the invention is defined by the following claims.

What is claimed is:

1. An antenna for a radio communication device, said antenna comprising:

a dielectric substrate, said dielectric substrate defining a first planar surface, a second planar surface extending from said first planar surface and perpendicular to said first planar surface, a third planar surface extending from said second planar surface and parallel to said first planar surface, a fourth planar surface extending from said third planar surface and parallel to said second planar surface, a fifth planar surface extending from said fourth planar surface and parallel to said first planar surface, and a sixth planar surface extending from and perpendicular to said first planar surface, said second planar surface, said third planar surface, said fourth planar surface, and said fifth planar surface;

a monopole defining a first end and a second end, said first end comprising a feed point connection disposed on said first planar surface, said monopole being folded about said dielectric substrate to extend from said first planar surface to said a second planar surface to said third planar surface to said fourth planar surface to said fifth planar surface to said sixth planar surface, said second end being disposed on said sixth planar surface;

a first patch forming a first matching element, said first patch extending from and being contiguous and integral with said monopole, said first patch further being defined in said fifth planar surface and matched at least at a first frequency band;

a second patch forming a second matching element, said second patch being proximate to said feed point connection and extending from and being contiguous and integral with said monopole, said second patch further being defined in said sixth planar surface and matched at least at a second frequency band; and a third patch forming a third matching element, said third patch extending from and being contiguous and integral with said second end of said monopole, said third patch further being defined in said sixth planar surface and matched at least at a third frequency band.

2. The antenna of claim 1 further comprising a ground plane extending across at least a portion of said fifth planar surface.

3. The antenna of claim 1 wherein said monopole is serpentine-shaped.

4. The antenna of claim 1 wherein said monopole is a folded monopole.

5. The antenna of claim 1 wherein said monopole is defined by a lengthwise dimension of about a quarter of a wavelength of a lowest frequency wavelength at which said antenna is to be operated.

6. The antenna of claim 1 wherein said monopole is defined by a lengthwise dimension of about a quarter of a wavelength at about 800 MHz.

7. The antenna of claim 1 wherein said monopole is defined by a lengthwise dimension determined with reference to the fundamental resonating mode of said antenna.

8. The antenna of claim 1 wherein said dielectric substrate defines a relative permittivity of about 4.4.

9. The antenna of claim 1 wherein said first patch, said second patch, and said third patch are sized for improving the matching of frequency bands at which said antenna is to be operated.

10. The antenna of claim 1 coupled to transceiver circuitry of a radio device.

11. The antenna of claim 1 wherein said monopole, said first patch, said second patch, and said third patch are configured for antenna resonance between 800 MHz and 2450 MHz.

12. The antenna of claim 1 wherein said monopole, said first patch, said second patch, and said third patch are configured for antenna resonance at frequency bands comprising at least one of or beyond 800 MHz, 900 MHz, 1500 MHz, 1800 MHz, 1900 MHz, 2000 MHz, 2200 MHz, 2400 MHz, and 2450 MHz.

13. A method for transducing signal energy at a radio device, said method comprising the operations of:

fabricating a substrate from a dielectric, said substrate defining a first planar surface, a second planar surface perpendicular to said first planar surface, a third planar surface parallel to said first planar surface, a fourth planar surface parallel to said second planar surface, a fifth planar surface parallel to said third planar surface, and a sixth planar surface perpendicular to said first planar surface, said second planar surface, said third planar surface, said fourth planar surface, and said fifth planar surface;

forming a monopole defining a first end and a second end, said first end comprising a feed point connection disposed on said first planar surface, said monopole being folded about said dielectric substrate to extend from said first planar surface to said a second planar surface to said third planar surface to said fourth planar surface to said fifth planar surface to said sixth planar surface, said second end being disposed on said sixth planar surface;

forming a first patch comprising a first matching element, said first patch extending from and being contiguous and integral with said monopole, said first patch further being defined in said fifth planar surface and matched at least at a first frequency band;

forming a second patch comprising a second matching element, said second patch being proximate to said feed point connection and extending from and being contiguous and integral with said monopole, said second patch further being defined in said sixth planar surface and matched at least at a second frequency band;

forming a third patch comprising a third matching element, said third patch extending from and being contiguous and integral with said second end of said monopole, said third patch further being defined in said sixth planar surface and matched at least at a third frequency band; and transducing signal energy within at least one of said monopole, said first patch, said second patch, and said third patch.

14. The method of claim 13 further comprising the operation of tuning the monopole.

15. The method of claim 13 further comprising the operation of extending a ground plane across at least a portion of said fifth planar surface.

16. The method of claim 13 wherein said operation of forming the monopole comprises forming a folded monopole.

17. The method of claim 13 wherein said monopole formed during said operation of forming the monopole is defined by a lengthwise dimension determined with reference to the fundamental resonating mode of said antenna.

18. A nine-band antenna assembly for a nine-band radio device, said nine-band antenna comprising:

a dielectric substrate defining at least three planar surfaces;

a folded monopole extending in a serpentine manner across at least three of said at least three planar surfaces of said dielectric substrate;

a first patch forming a first matching element, said first patch extending from and being contiguous and integral with said monopole, said first patch further matched at least at a first frequency band;

a second patch forming a second matching element, said second patch being proximate to said feed point connection and extending from and being contiguous and integral with said monopole, said second patch further matched at least at a second frequency band; and a third patch forming a third matching element, said third patch extending from and being contiguous and integral with said second end of said monopole, said third patch further matched at least at a third frequency band.

19. The antenna of claim 18 further comprising a ground plane extending across at least a portion of said dielectric substrate.

20. The antenna of claim 18 wherein said monopole is defined by a lengthwise dimension determined with reference to the fundamental resonating mode of said antenna.

* * * * *